US011317672B2

(12) United States Patent
Dunton

(10) Patent No.: US 11,317,672 B2
(45) Date of Patent: May 3, 2022

(54) ENERGY ABSORPTION SYSTEM FOR A HELMET

(71) Applicant: Nick M. Dunton, Wapiti, WY (US)

(72) Inventor: Nick M. Dunton, Wapiti, WY (US)

( * ) Notice: Subject to any disclaimer, the term of this patent is extended or adjusted under 35 U.S.C. 154(b) by 331 days.

(21) Appl. No.: 16/016,261

(22) Filed: Jun. 22, 2018

(65) Prior Publication Data

US 2019/0387826 A1 Dec. 26, 2019

(51) Int. Cl.

| | |
|---|---|
| ***A42B 3/00*** | (2006.01) |
| ***A42B 3/04*** | (2006.01) |
| ***A42B 3/06*** | (2006.01) |
| ***A42B 3/12*** | (2006.01) |
| *A63B 71/12* | (2006.01) |

(52) U.S. Cl.

CPC ..... *A42B 3/0406* (2013.01); *A42B 3/0493* (2013.01); *A42B 3/062* (2013.01); *A42B 3/121* (2013.01); *A42B 3/127* (2013.01); *A63B 71/12* (2013.01); *A63B 2209/00* (2013.01)

(58) Field of Classification Search

CPC ..... A42B 3/0406; A42B 3/0493; A42B 3/062; A42B 3/121; A42B 3/127; A42B 71/12; A63B 71/12; A63B 2209/00

USPC ..... 2/411

See application file for complete search history.

(56) References Cited

U.S. PATENT DOCUMENTS

| | | | | |
|---|---|---|---|---|
| 3,174,155 | A | 3/1965 | Pitman | |
| 3,815,152 | A | 6/1974 | Bednarczuk et al. | |
| 3,843,970 | A * | 10/1974 | Marietta | A42B 3/127 2/415 |
| 4,023,213 | A * | 5/1977 | Rovani | A42B 3/121 2/413 |
| 4,223,409 | A | 9/1980 | Lee | |
| 4,660,230 | A | 4/1987 | Mayling | |
| 4,937,888 | A | 7/1990 | Straus | |
| 5,227,433 | A * | 7/1993 | Frankel | C08F 291/00 428/35.7 |
| 6,272,692 | B1 * | 8/2001 | Abraham | A42B 3/063 2/411 |
| 6,314,586 | B1 | 11/2001 | Duguid | |
| 6,389,607 | B1 | 5/2002 | Wood | |
| 8,826,468 | B2 | 9/2014 | Harris | |
| 8,938,817 | B1 | 1/2015 | Baldi | |
| 8,966,671 | B2 | 3/2015 | Rumbaugh | |
| 9,119,431 | B2 | 9/2015 | Bain | |
| 9,314,063 | B2 | 4/2016 | Bologna et al. | |
| 9,629,409 | B1 | 4/2017 | Cannon, Jr. et al. | |
| 9,808,042 | B2 * | 11/2017 | Hoying | A42B 3/069 |
| 2007/0157370 | A1 * | 7/2007 | Joubert Des Ouches | A42B 3/064 2/410 |
| 2011/0179557 | A1 | 7/2011 | Rabie | |
| 2012/0036619 | A1 | 2/2012 | Ytterborn et al. | |
| 2012/0317705 | A1 * | 12/2012 | Lindsay | A42B 3/20 2/413 |

(Continued)

*Primary Examiner* — Richale L Quinn
(74) *Attorney, Agent, or Firm* — Dunlap Codding, P.C.

(57) ABSTRACT

An energy absorption system is provided with a plurality of energy absorbing panels that may be releasably connected to a helmet. The energy absorbing panels are provided with a plurality of air flow channels defining a plurality of energy absorption chambers. Each of the air flow channels is designed to direct air flow from an anterior of the helmet to a posterior of the helmet when the energy absorbing panels are connected to an outer shell of the helmet.

6 Claims, 5 Drawing Sheets

(56) References Cited

U.S. PATENT DOCUMENTS

| | | | | |
|---|---|---|---|---|
| 2013/0031700 | A1* | 2/2013 | Wacter | A42B 3/322 2/411 |
| 2013/0298316 | A1 | 11/2013 | Jacob | |
| 2014/0259309 | A1 | 9/2014 | Pettersen | |
| 2015/0082523 | A1* | 3/2015 | Wyner | B32B 27/32 2/455 |
| 2016/0227867 | A1* | 8/2016 | Twardowski | A42B 3/063 |

* cited by examiner

ENERGY ABSORPTION SYSTEM FOR A HELMET

BACKGROUND

Many helmet designs are shells of a hard material such as plastic with some variation of energy-absorbing material, such as foam, air pads, or a combination of both, placed inside the shell. These helmet designs attempt to balance functional features against an overall challenge of cost constraint. In this regard, attempts are made to design helmets that not only resist the required impacts of their specific sport, but to incorporate other criteria such as adequate ventilation, weight, stand-off distance from the user's head contours ("helmet profile"), and overall comfort. Such attempts are generally lacking to various degrees. Current helmet designs can be described as having two-stage energy absorption. In this respect, a hard, outer shell dissipates some of the impact load ("Stage 1") and the materials inside the helmet further dissipate impact loads ("Stage 2").

Due to the needs of creating a shell that is tough, durable, and long-lasting many helmets are constructed with polycarbonate or acrylonitrile butadiene styrene (ABS) plastic molded shells that are thick and rigid. These thick, rigid shells do not dissipate much energy during an impact, and as such, transfer much of it to the absorption materials inside the helmet. Therefore, Stage 1 of the energy absorption mechanism is largely ineffective, and the bulk of energy absorption is accomplished by Stage 2 design elements, namely the foams and air pads inside the hard shell.

A need exists therefore, for helmet technology that incorporates additional energy absorption because it can potentially decrease the incidence of athlete injury caused by traumatic head injuries, concussions, or repetitive head trauma.

BRIEF DESCRIPTION OF THE DRAWINGS

To assist those of ordinary skill in the relevant art in making and using the subject matter hereof, reference is made to the appended drawings, which are not intended to be drawn to scale, and in which like reference numerals are intended to refer to similar elements for consistency. For purposes of clarity, not every component may be labeled in every drawing.

DETAILED DESCRIPTION

Figure 1A:
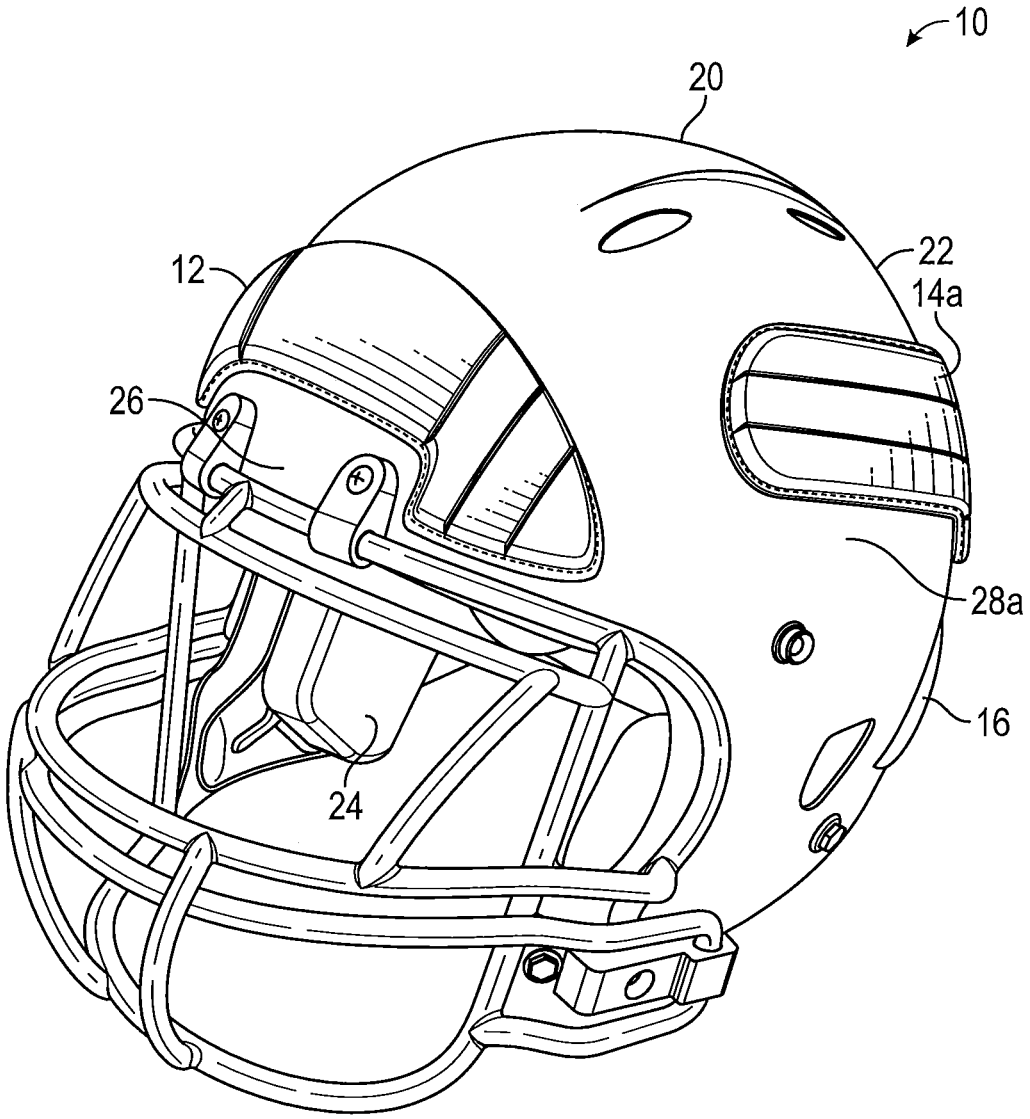
FIG. 1A is a front perspective view of a football helmet with impact absorbing panels of an energy absorption system removably connected to an outer shell of the helmet in accordance with one embodiment of the present disclosure.

The inventive concepts will now will be described more fully hereinafter with reference to the accompanying drawings, which form a part hereof, and which show, by way of illustration, specific exemplary embodiments by which the inventive concepts may be practiced. Before explaining at least one embodiment of the disclosure in detail, it is to be understood that the disclosure is not limited in its application to the details of construction and/or the arrangement of the components set forth in the following description or illustrated in the drawings unless otherwise noted.

The systems and methods as described in the present disclosure are capable of other embodiments or of being practiced or carried out in various ways. Also, it is to be understood that the phraseology and terminology employed herein is for purposes of description, and should not be regarded as limiting.

For example, in the context of the present disclosure, the apparatus hereof finds particular use in connection with sports helmets such as football helmets, baseball helmets, hockey helmets, and the like. Additionally, the specific characteristics of each embodiment of the present disclosure are adapted to be optimized for performance in a particular sport. However, generally speaking, numerous applications of the present disclosure may be realized.

For example, although sports helmets are primarily used in conjunction with participation in an athletic activity, their general purpose is to protect the user's head from impact trauma. Accordingly, as used herein, the term "helmet" means any head-protective apparatus which at least partially surrounds the user's head. Briefly, other protective gear, such as elbow pads, knee pads, shin guards, and the like, may likewise benefit from the present disclosure, and use of the term "helmet" is not intended to limit the scope, applicability, or configuration of the disclosure in any way.

Likewise, numerous materials may be used to achieve each element of the apparatus disclosed herein. Generally speaking, elements of the disclosure may be made of various materials and composites, including polycarbonate plastic, ABS plastic, carbon fiber, metals, ceramics, polystyrene foam, vinyl nitrile foam, and thermoplastic urethane foam. Although an exhaustive list of materials is not included herein, one skilled in the relevant art will appreciate that various polyurethane foams and other energy-absorbing materials may be used, all of which fall within the scope of the present disclosure.

Additionally, various materials may be combined to obtain the most attractive characteristics of existing (or as yet unknown) plastics, energy-absorbing materials, and composite materials, and may be incorporated into the helmet elements disclosed herein, whose combined performance characteristics may potentially increase impact energy absorption or cost efficiency.

The following detailed description refers to the accompanying drawings. The same reference numbers in different drawings may identify the same or similar elements.

As used in the description herein, the terms "comprises," "comprising," "includes," "including," "has," "having," or any other variations thereof, are intended to cover a non-exclusive inclusion. For example, unless otherwise noted, a process, method, article, or apparatus that comprises a list of elements is not necessarily limited to only those elements, but may also include other elements not expressly listed or inherent to such process, method, article, or apparatus.

Further, unless expressly stated to the contrary, "or" refers to an inclusive and not to an exclusive "or". For example, a condition A or B is satisfied by one of the following: A is true (or present) and B is false (or not present), A is false (or not present) and B is true (or present), and both A and B are true (or present).

In addition, use of the "a" or "an" are employed to describe elements and components of the embodiments herein. This is done merely for convenience and to give a general sense of the inventive concept. This description should be read to include one or more, and the singular also includes the plural unless it is obvious that it is meant otherwise. Further, use of the term "plurality" is meant to convey "more than one" unless expressly stated to the contrary.

As used herein, any reference to "one embodiment," "an embodiment," "some embodiments," "one example," "for example," or "an example" means that a particular element, feature, structure or characteristic described in connection with the embodiment is included in at least one embodiment. The appearance of the phrase "in some embodiments" or "one example" in various places in the specification is not necessarily all referring to the same embodiment, for example.

As noted above, in conventional sports helmets, impact energy is dissipated in two stages, as accomplished by a hard, outer shell and an inner, energy-absorbing layer. In accordance with the present disclosure, further stages of impact energy absorption can be achieved through incorporation of energy absorbing panel elements.

Figure 1B:
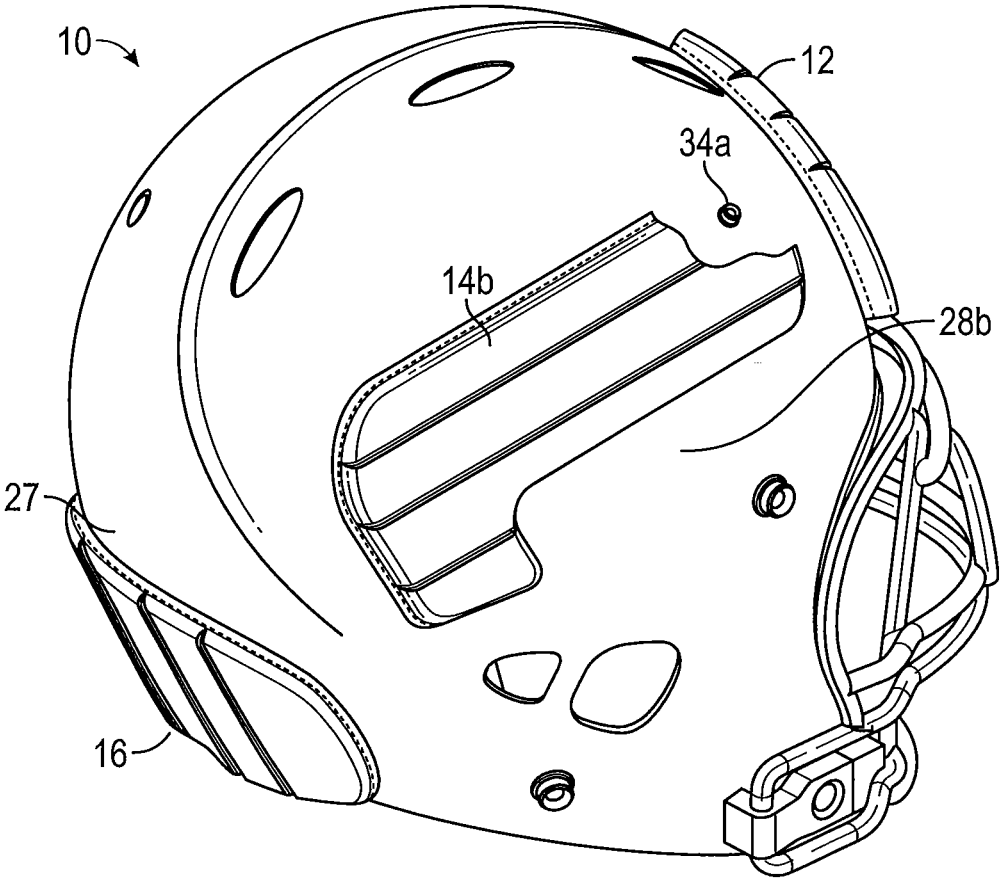
FIG. 1B is a partial cutaway, rear perspective view of the football helmet of FIG. 1A.

Referring now to FIGS. 1A and 1B, in accordance with one embodiment of the present disclosure, an energy absorption system 10 is provided with a first energy-absorbing panel 12, at least one second energy-absorbing panel 14*a* and 14*b*, and a third energy-absorbing panel 16. The first energy-absorbing panel 12, at least one second energy-absorbing panels 14*a* and 14*b*, and the third energy-absorbing panel 16 are removably connected to a helmet 20 having a shell 22 and an energy-absorbing layer 24.

The shell 22 of the helmet 20 may be adapted to absorb impact energy. When the helmet 20 is worn by a user, the shell 22 at least partially surrounds the user's head and provides the structural base of the helmet 20. The shell 22 may be hard and rigid, and its outer surface may be adapted to be painted, resurfaced, or refinished, potentially to accommodate graphic elements.

In various embodiments, the shell 22 may be made with materials such as ABS plastic, polycarbonate plastic, or the like. However, the shell 22 may be made of any number of plastics, energy-absorbing materials, or composite materials. Further, the physical characteristics of the shell, such as flexibility, hardness, weight, and shape, may be varied in any way necessary to accomplish the desired performance characteristics while still falling within the scope of the present disclosure.

In the exemplary embodiment illustrated in FIGS. 1A and 1B, the shell 22 is shaped like a conventional football helmet and is located on the exterior of the helmet 20, contiguous with an inner, energy-absorbing layer 24. However, the shell 22 may be shaped to accommodate the needs of any particular sport, or more generally, in any way that at least partially surrounds the user's head. Further, the shell 22 need not constitute the outermost layer of the helmet 20, but may be located anywhere to accomplish energy absorption.

The energy-absorbing layer 24 may be adapted to further absorb energy. The energy-absorbing layer 24 may be more energy-absorbent than the shell 22 and may be comprised of foam lining, foam pads, air pads, or any combination thereof.

The energy-absorbing layer 24 may be made of any material that is sufficiently adapted to absorb impact energy. For example, foam lining and foam pads generally may be made of polystyrene foam, vinyl nitrile foam, or thermoplastic urethane foam. Air pads generally may comprise bladders adapted to be filled with air and may be made of vinyl or a similarly flexible plastic material.

The energy-absorbing layer 24 may be located inside the shell 22, and may be contiguous with an inner surface of the shell 22. In embodiments comprising foam pads or air pads, the pads may be placed strategically inside the helmet 20 to meet the specific requirements of a particular sport, or to optimize characteristics such as energy absorption, user comfort, and helmet profile. The energy-absorbing layer 24 need not be contiguous with the shell 22, and other elements may be interposed between the shell 22 and the energy-absorbing layer 24.

In accordance with the present disclosure, further energy absorption may be accomplished by the releasable attachment of the first energy-absorbing panel 12, the second energy-absorbing panels 14*a* and 14*b*, and the third energy-absorbing panel 16 to an outer surface of the shell 22. Attachment of the energy absorbing panels 12, 14*a*, 14*b*, and 16 to the shell 22 of the helmet 20 provides more effective energy absorption than the hard, outer shell of conventional helmets. Accordingly, improved energy absorption increases the ability of the helmet 20 to prevent injury. Further, the ability to remove and replace the energy absorbing panels 12, 14*a*, 14*b*, and 16 improves cost efficiencies by decreasing the cost of helmet refurbishment and the frequency of helmet replacement.

The energy absorbing panels 12, 14*a*, 14*b*, and 16 may be strategically located on the helmet 20 to meet the specific requirements of a particular sport. For example, in the exemplary embodiment of FIGS. 1A and 1B, the helmet 20 is a football helmet and the energy absorbing panels 12, 14*a*, 14*b*, and 16 are located on an anterior 26, posterior 27, and lateral 28*a* and 28*b* faces, which are likely to receive impacts as a result of tackling and, thus, are the most critical areas of the head in relation to incidence of trauma and concussion in football. In alternate embodiments, such as a baseball batter's helmet (not shown), for instance, energy absorbing panels may be located on portions of the baseball helmet, such as the posterior and lateral faces, which are likely to receive impacts as a result of a pitch. That being said, those skilled in the relevant art will appreciate that the location of the energy absorbing panels may vary depending on the particular requirements of each helmet, and the embodiments described herein is not intended to limit the scope of the present disclosure.

Figure 2A:
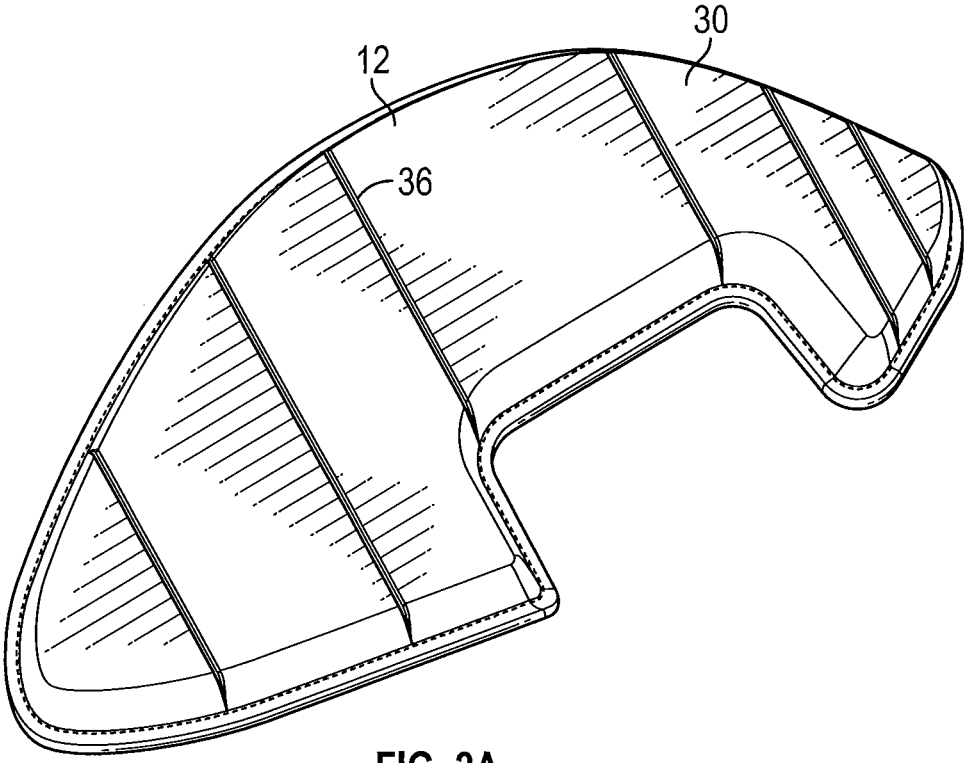
FIG. 2A is a front perspective view a first impact absorbing panel.
Figure 2B:
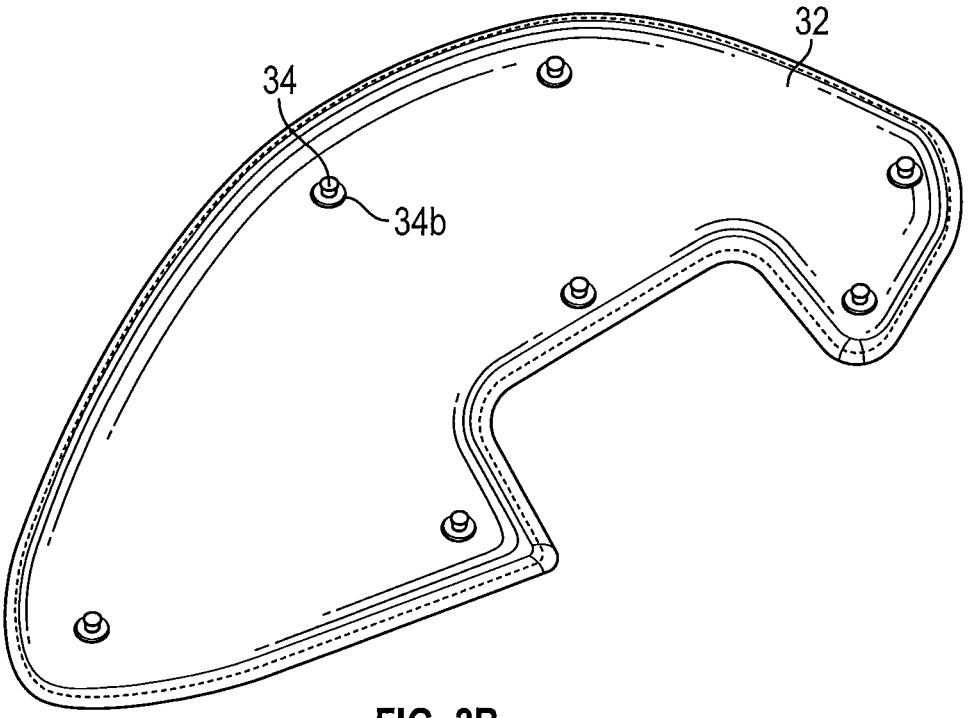
FIG. 2B is a back perspective view of the first impact absorbing panel of FIG. 2A.

Referring now to FIGS. 2A and 2B, the first energy absorbing panel 12 may be provided with a first face 30, a second face 32 opposite the first face 30, a connector for attaching the first energy absorbing panel 12 to the helmet 20, such as a plurality of snap fasteners 34 (only one of which is labeled in FIG. 2B), and a plurality of air flow channels 36 (only one of which is labeled in FIG. 2A).

The plurality of air flow channels 36 extend across the width of the first energy-absorbing panel 12 and are configured to direct air flow from the anterior 26 to the posterior 27 of the helmet 20 when the first energy-absorbing panel 12 is placed on the anterior 26 face of the helmet 20.

Snap fasteners 34 may each have a socket portion 34*a* (FIG. 1B) and a stud portion 34*b* (FIG. 2B). In the embodiments illustrated in FIGS. 1B and 2B, the socket portions 34*a* of the plurality of snap fasteners 34 are connected to the outer surface of the helmet 20 and the stud portions 34*b* of each of the plurality of snap fasteners are connected to the back side of the energy absorbing panels 12, 14*a*, 14*b*, and 16. It should be noted that the snap fasteners 34 may be arranged in any combination so long as the socket portion 34*a* is connected opposite the stud portion 34*b*.

It should be noted that the snap fasteners 34 are shown for the purposes of illustration only and other connectors for attaching the energy absorbing panels 12, 14*a*, 14*b*, and 16 to the helmet 20 may be used. For instance, the connectors for attaching the energy absorbing panels 12, 14*a*, 14*b*, and 16 to the helmet 20 may be snaps, hook-and-loop fasteners, screws, nuts and bolts, rivets, adhesives, or the like. Alternatively, the energy absorbing panels 12, 14*a*, 14*b*, and 16 may be connected to a cover that is formed to fit over the outside of the helmet 20.

Energy absorbing panels 14*a*, 14*b*, and 16 are formed substantially the same as energy absorbing panel 12. In particular, energy absorbing panels 14*a*, 14*b*, and 16 are provided with a front side, a back side, and a connector for attaching the energy absorbing panels 14*a*, 14*b*, and 16 to the helmet 20. Therefore, in the interest of brevity, only the features of energy absorbing panels 14*a*, 14*b*, and 16 that are different will be described in detail herein.

Figure 3A:
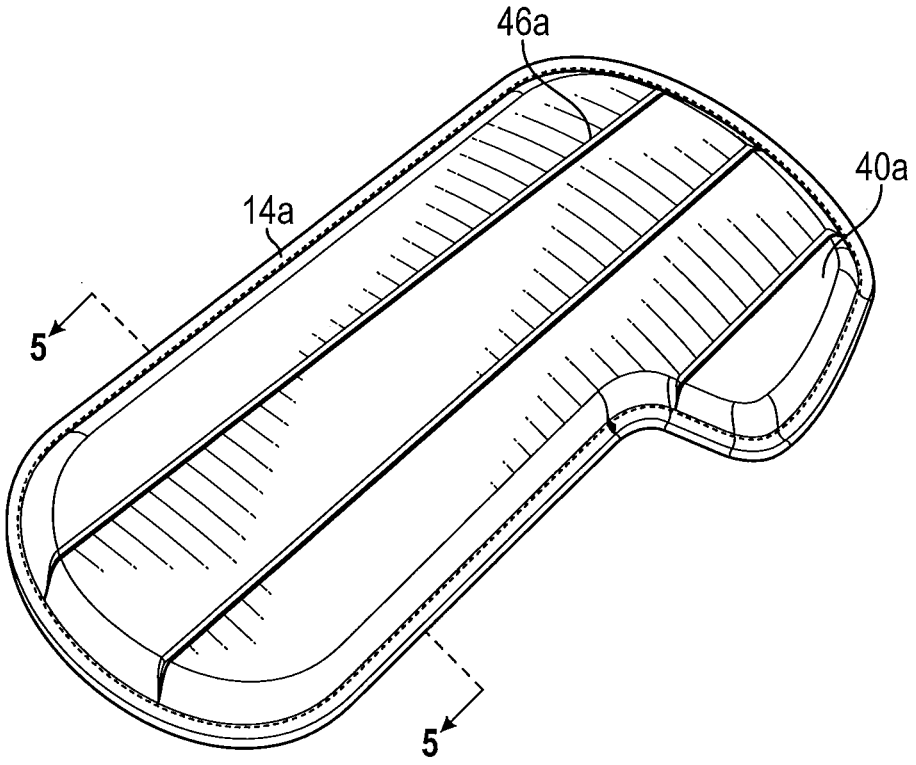
FIG. 3A is a front perspective view of a second impact absorbing panel.
Figure 3B:
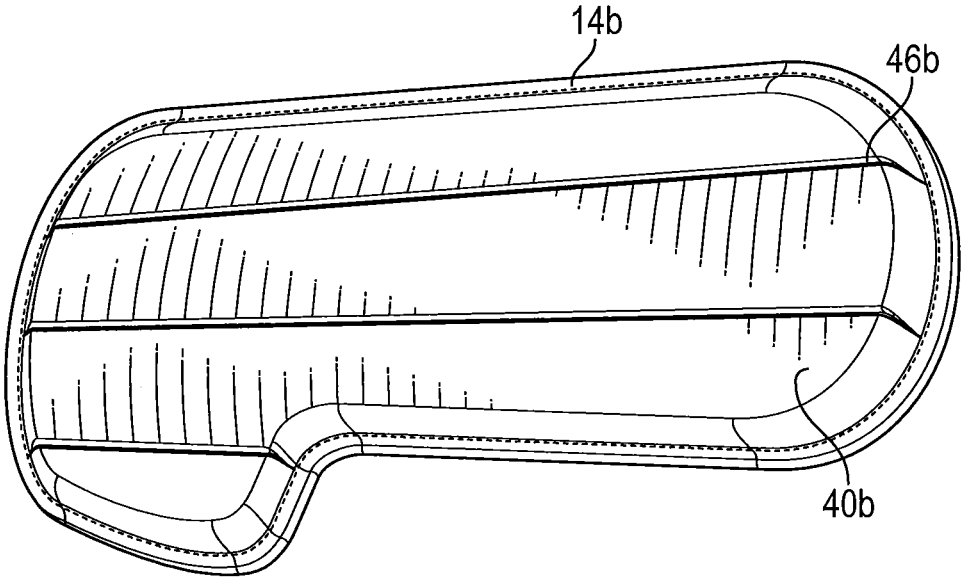
FIG. 3B is a front perspective view of another second impact absorbing panel.

Referring now to FIGS. 3A and 3B, the second energy-absorbing panels 14*a* and 14*b* are provided with a plurality of air flow channels 46*a* and 46*b* (only one of which is labeled in FIGS. 3A and 3B). The second energy-absorbing panels 14*a* and 14*b* are designed to be placed on opposite lateral faces 28*a* and 28*b* of the helmet 20. The air flow channels 46*a* and 46*b* extend the length of the second energy-absorbing panels 14*a* and 14*b* and are configured to direct air flow from the anterior 26 to the posterior 27 of the helmet 20 when the second energy-absorbing panels 14*a* and 14*b* are placed on the lateral 28*a* and 28*b* faces of the helmet 20.

Figure 4:
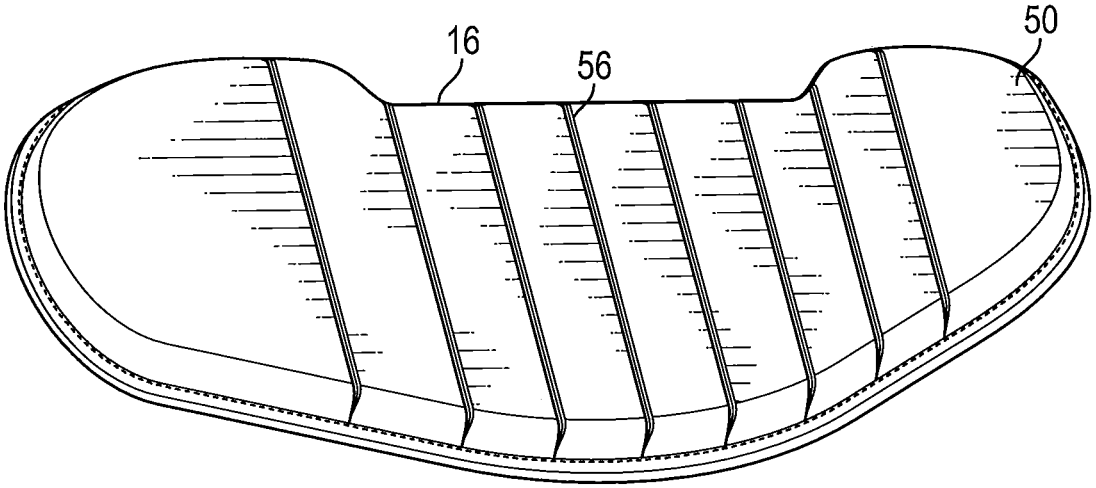
FIG. 4 is a front perspective view a third impact absorbing panel.

Referring now to FIG. 4, the third energy-absorbing panel 16 is provided with a plurality of air flow channels 56 (only one of which is labeled in FIG. 4). The air flow channels 56 extend across the width of the third energy-absorbing panel 16 and are configured to direct air flow from the anterior 26 to the posterior 27 of the helmet 20 when the third energy-absorbing panel 16 is placed on the posterior 27 face of the helmet 20.

Figure 5:
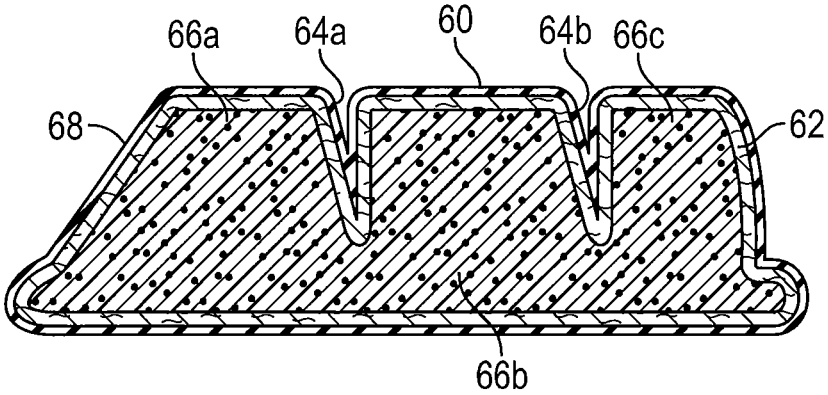
FIG. 5 is a cross-sectional view of the second impact absorbing panel taken along line 5-5 of FIG. 3A.

The energy absorbing panels 12, 14*a*, 14*b*, and 16 may be made of various energy absorbing materials or composites such as polyurethane foam, for instance, covered by a layer of protective material such as leather. As illustrated in FIG. 5, a leather cover 60 covers a polyurethane foam 62 energy absorbing material. The leather cover 60 has a latex coating 68 which protects and seals the leather cover 60. Air flow channels 64*a* and 64*b* are formed in the polyurethane foam 62 energy absorbing material define energy absorbing chambers 66*a*, 66*b*, and 66*c*. The leather cover 60 may be sealed with a waterproof material such as latex paint to further protect the polyurethane foam 62 energy absorbing material as well as serving an aesthetic function as the color of the energy absorbing panels 12, 14*a*, 14*b*, and 16 may be selected to match and/or compliment the color of the helmet 20, for instance.

The energy absorbing panels 12, 14*a*, 14*b*, and 16 may have a thickness measured from the first face 30 to the second face 32 in a range of about ½ inch to about 1 inch. It should be noted that in some embodiments the energy absorbing panels 12, 14*a*, 14*b*, and 16 may be the same thickness, or, in other embodiments the energy absorbing panels 12, 14*a*, 14*b*, and 16 may have different thicknesses (e.g., an energy absorbing panel connected to the anterior face 26 of the helmet 20 may have a thickness greater that an energy absorbing panel connected to a posterior face 27 of the helmet 20). Further, the energy absorbing panels 12, 14*a*, 14*b*, and 16 may be provided with different thicknesses across a single energy absorbing panel. For instance, energy absorbing panel 12 may be thicker in the center and thinner at the lateral edges such that the center of the energy absorbing panel may be capable of absorbing more energy than the lateral edges.

The air flow channels 64*a* and 64*b* function to increase aerodynamic performance, increase aesthetic appeal, decrease weight, and provide a hinge to facilitate conforming the energy absorbing panels 12, 14*a*, 14*b*, and 16 to the helmet, among other things. It should be noted that air flow channels 36, 46, and 56 are formed in similar fashion and perform the same functions as air flow channels 64*a* and 64*b*. In the illustrated embodiments, when the energy absorbing panels 12, 14*a*, 14*b*, and 16 are connected to the helmet 20 the air flow channels 36, 46, and 56 are generally orientated with a longitudinal axis of the helmet 20 and extend parallel with one another.

While the energy absorbing material has been described herein as polyurethane foam, it should be understood that different properties and their concomitant benefits may be realized through use of materials that vary in stiffness, strength, weight, flexibility, hardness, energy-absorption ability, cost, or any other characteristic.

It should be noted that the energy absorbing panels 12, 14*a*, 14*b*, and 16 described herein may be retrofitted to previously-existing helmets, or alternatively may be manufactured in connection with new helmets, providing the utmost in versatility to those in need of protective headgear.

From the above description, it is clear that the inventive concept(s) disclosed herein are well adapted to carry out the objects and to attain the advantages mentioned herein, as well as those inherent in the inventive concept(s) disclosed herein. While the embodiments of the inventive concept(s) disclosed herein have been described for purposes of this disclosure, it will be understood that numerous changes may be made and readily suggested to those skilled in the art which are accomplished within the scope and spirit of the inventive concept(s) disclosed herein.

What is claimed is:

1. An energy absorption system, comprising:

a helmet having a shell with an inner surface and an outer surface, the outer surface having an anterior face, a posterior face, a first lateral face and a second lateral face, the first and second lateral faces opposite each other;

a first energy absorbing panel having a front side and a back side, the back side of the first energy absorbing panel connected to the anterior face of the helmet;

at least two second energy absorbing panels, each of the at least two second energy absorbing panels having a front side and a back side, the back side of a first one of the second energy absorbing panels connected to the first lateral face and a second one of the second energy absorbing panels connected to the second lateral face of the helmet;

a third energy absorbing panel having a front side and a back side, the back side of the third energy absorbing panel connected to the posterior face of the helmet;

wherein each of the front side of the first energy absorbing panel, the at least two second energy absorbing panels, and the third energy absorbing panel has a plurality of air flow channels defining a plurality of energy absorption chambers, wherein the air flow channels of the first energy absorbing panel are open-ended along a longitudinal axis of each of the air flow channels of the first energy absorbing panel and extend across at least a portion of the first energy absorbing panel, wherein the air flow channels of the second energy absorbing panels are open-ended along a longitudinal axis of each of the air flow channels of the second energy absorbing panels and extend across at least a portion of the second energy absorbing panels, wherein the air flow channels of the third energy absorbing panel are open-ended along a longitudinal axis of each of the air flow channels of the third energy absorbing panel and extend across at least a portion of the third energy absorbing panel, and wherein the air flow channels of the first energy absorbing panel, the second energy absorbing panels, and the third energy absorbing panel are arranged so the longitudinal axis of the air flow channels extend along a line extending in an anterior to posterior direction.

2. The energy absorption system for a helmet of claim 1, wherein the first energy absorbing panel, the at least two second energy absorbing panels, and the third energy absorbing panel are formed of a polyurethane foam covered by a protective material.

3. The energy absorption system for a helmet of claim 2, wherein the protective material is leather.

4. The energy absorption system for a helmet of claim 3, wherein the leather is sealed with a latex coating.

5. The energy absorption system for a helmet of claim 1, wherein the first energy absorbing panel, the at least two second energy absorbing panels, and the third energy absorbing panel are connected to the outer surface of the helmet with a plurality of snap fasteners each having a socket portion and a stud portion, one of the socket portions or the stud portions of each of the plurality of snap fasteners is connected to the back side of the first energy absorbing panel, the at least two second energy absorbing panels, and the third energy absorbing panel and the other one of the socket portions or the stud portions of the plurality of snap fasteners is connected to the outer surface of the helmet.

6. The energy absorption system for a helmet of claim 1, wherein the first energy absorbing panel, the at least two second energy absorbing panels, and the third energy absorbing panel are spaced apart from one another.

* * * * *